US009749742B2

(12) United States Patent
Reining et al.

(10) Patent No.: US 9,749,742 B2
(45) Date of Patent: Aug. 29, 2017

(54) ELECTRIC ROCKING MODE DAMPER

(71) Applicant: Sound Solutions International Co., Ltd., Beijing (CN)

(72) Inventors: Friedrich Reining, Vienna (AT); Heribert Bauer, Siegendorf (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 15/213,951

(22) Filed: Jul. 19, 2016

(65) Prior Publication Data

US 2017/0026746 A1 Jan. 26, 2017

Related U.S. Application Data

(60) Provisional application No. 62/194,784, filed on Jul. 20, 2015.

(51) Int. Cl.

| | |
|---|---|
| ***H04R 3/00*** | (2006.01) |
| ***H04R 1/28*** | (2006.01) |
| ***H04R 9/02*** | (2006.01) |
| ***H04R 9/06*** | (2006.01) |

(52) U.S. Cl.

CPC ..... *H04R 3/007* (2013.01); *H04R 1/2873* (2013.01); *H04R 3/002* (2013.01); *H04R 9/025* (2013.01); *H04R 9/06* (2013.01)

(58) Field of Classification Search

CPC ..... H04R 1/2873; H04R 9/06; H04R 9/025; H04R 3/002; H04R 3/007

See application file for complete search history.

(56) References Cited

U.S. PATENT DOCUMENTS

| | | | |
|---|---|---|---|
| 9,271,085 | B2 | 2/2016 | Kim |
| 2007/0076914 | A1 | 4/2007 | Takagi et al. |
| 2009/0185711 | A1 | 7/2009 | Shigeta et al. |
| 2011/0075880 | A1 | 3/2011 | Kamimura et al. |
| 2013/0259272 | A1 | 10/2013 | Kim |

FOREIGN PATENT DOCUMENTS

| | | | | |
|---|---|---|---|---|
| CN | 202035136 | U | 9/2011 | |
| JP | 2009253795 | A | 10/2009 | |
| WO | WO 2011155676 | A1 * | 12/2011 | ..... H04R 9/02 |

OTHER PUBLICATIONS

International Search Report, PCT/CN2016/090430.
Written Opinion of International Search Report, PCT/CN2016/090430.

* cited by examiner

*Primary Examiner* — Brenda Bernardi
(74) *Attorney, Agent, or Firm* — Steven McMahon Zeller; Dykema Gossett PLLC

(57) ABSTRACT

The invention relates to a new audio transducer for mobile devices, in particular a micro speaker for use in mobile phones, tablets, gaming devices, notebooks or similar devices, that comprises two figure-8 shaped coils to compensate tumbling passively or to detect and compensate actively rocking modes of the membrane along the two axes perpendicular to the axis of piston-wise movement of the membrane using a detection coil and a damping coil per axis. An amplifier may be used to amplify the detection signal in order to increase the damping effect. Electrical rocking mode compensation replaces state of the art damping mechanisms which are based on damping materials added in the moving part of the membrane. Due to the independence of environmental conditions electrical damping outperforms existing damping techniques.

12 Claims, 7 Drawing Sheets

ELECTRIC ROCKING MODE DAMPER

BACKGROUND OF THE INVENTION

A. Field of the Invention

The invention relates to an audio transducer to transduce an electrical audio signal into acoustic sound. This invention furthermore relates to a micro speaker optimized for high acoustic output and located within a small volume of a mobile device, such as a mobile phone, a tablet, a gaming device, a notebook or similar device. As the physical volume within these mobile devices is very limited and as the audio transducer has to fit into the housing of the mobile device together with other modules having rectangular shapes, the micro speaker quite often must be constructed having a rectangular form factor.

B. Background Art

When maximizing the performance of a speaker to output high sound pressure an important parameter is a piston wise movement of the membrane. Asymmetry of the mechanical system of a speaker results in asymmetric movements or tumbling of the membrane. This can reduce the sound pressure output power and may result in severe rubbing and buzzing and even damaging of the mechanical system of the speaker. Prior attempts to solve this problem of a tumbling membrane are based on damping membrane materials. The efficiency of such damping, however, can strongly depend on environmental conditions. The invention described herein provides for damping of a tumbling membrane by electrical means and is therefore in a wide range independent from environmental conditions.

Since common membrane designs cannot prevent the system from tumbling, usage of damping membrane material is the most effective and cheap solution. Membrane material, however, has to fulfil many requirements, including having the following characteristics: 1) stabile, frequency-independent stiffness and damping; 2) robustness against mechanical long term stresses; and 3) low cost and good process ability.

Actual materials are always a compromise when it comes to fulfilment of all these requirements, resulting in more or less distortion in the output sound pressure. The resulting total harmonic distortion (THD) is one method used to rate the performance of membranes.

Overcoming tumbling through electrical means requires a method to detect and/or measure the damping during operation of the speaker. One method of doing so is to include a sensor coil wound over the whole height of the voice coil that drives the membrane. The magnetic flux of the magnet system of the speaker will induce a voltage in both coils depending of the actual position of the coil with respect to the magnet system. In a single coil sensor, the induced voltage caused by the forces of tumbling will cancel out due to the fact that the rotational center tends to be through the center of gravity for the coil. The tumbling of the membrane thus cannot be detected.

SUMMARY OF THE INVENTION

It is an objective of the invention to solve the tumbling problem without the usage of additional mechanical requirements for the membrane material. A new audio transducer for mobile devices, in particular a micro speaker for use in mobile phones, tablets, gaming devices, notebooks or similar devices, comprises two figure-8 shaped detection coils to detect tumbling of the membrane along the two axes perpendicular to the axis of piston-wise movement of the membrane. A damping coil may be used to feed-in the detection signal from the detection coils to electrically damp tumbling of the membrane. An amplifier may be used to amplify the detection signal and to increase the damping effect. With this electrical damping of a tumbling membrane the advantage is achieved that there is no need to add damping material to the membrane and that damping in a wide range is independent from environmental conditions.

The foregoing and other aspects, features, details, utilities, and advantages of the present invention will be apparent from reading the following description and claims, and from reviewing the accompanying drawings.

BRIEF DESCRIPTION OF THE DRAWINGS

Further embodiments of the invention are indicated in the figures and in the dependent claims The invention will now be explained in detail by the drawings. In the drawings:

DETAILED DESCRIPTION OF EMBODIMENTS

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Figure 1:
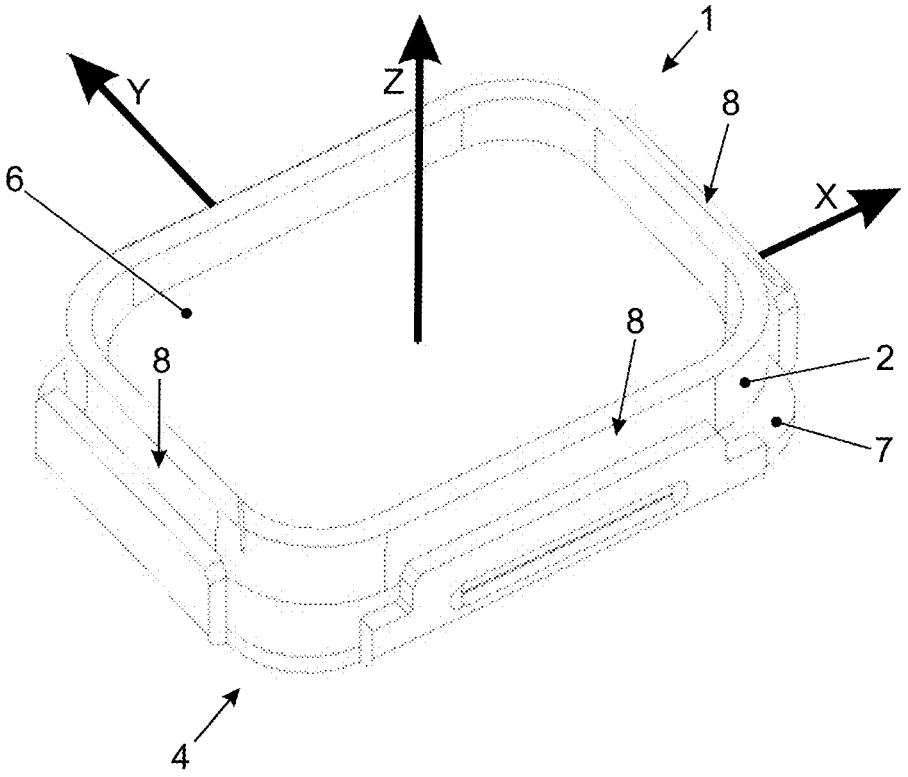
FIG.1 (PRIOR ART)
FIG. 1 shows a perspective view of some of the relevant parts of a prior art rectangular micro speaker.
Figure 2:
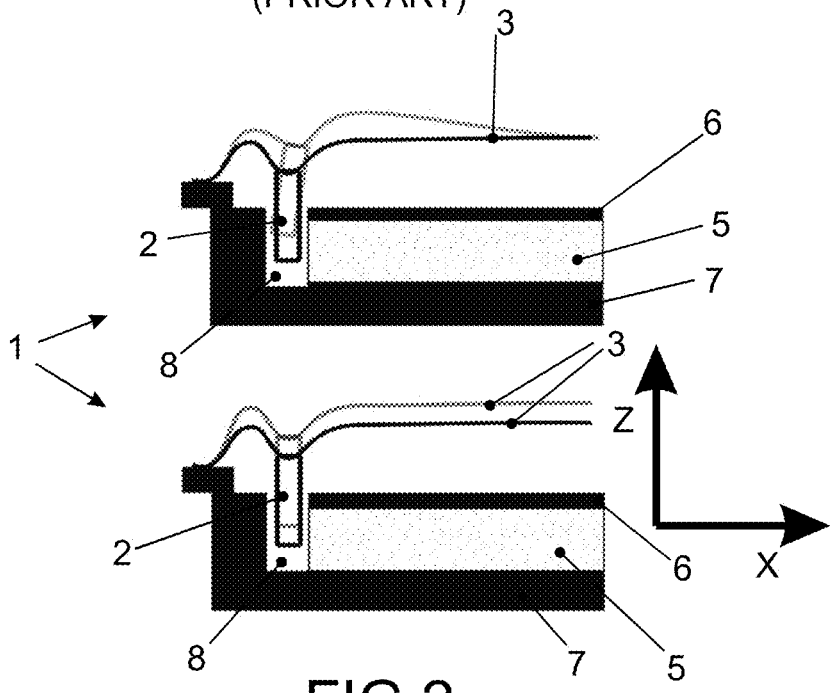
FIG.2 (PRIOR ART)
FIG. 2 shows two sectional drawings of part of the speaker of FIG. 1.

FIGS. 1 and 2 show views of some of the relevant parts of a prior art rectangular micro speaker 1. FIG. 1 shows a perspective view and FIG. 2 shows two sectional views. Speaker 1 comprises a voice coil 2 with leads (unshown) to feed an electrical signal into voice coil 2. When micro speaker 1 is assembled, voice coil 2 is fixed to a membrane 3 with, e.g. glue. A membrane 3 of micro speaker 1 is typically made from one or more layers of material, such as Ethere Ketone (PEEK) and/or Acrylat and/or Thermoplastic Elastomeric (TEP) and/or Polyetherimide (PEI). The assembled micro speaker 1 may also comprise a membrane plate (unshown) to stiffen the membrane 3.

Prior art speaker 1 furthermore comprises a magnet system with a magnet 5 arranged in the center of speaker 1. The magnet system furthermore comprises magnetic field guiding means comprising a top plate 6 fixed to magnet 5 and a pot 7. The magnetic field guiding means guides and focuses the magnetic field of magnet 5 in an air gap 8 between the magnet 5 and the sides of the pot 7. The voice coil 2 is arranged in the air gap 8.

The two sectional drawings in FIG. 2 show the movement of voice coil 2 and membrane 3. In the lower sectional drawing, a micro speaker 1 having a perfect mechanical system is shown. The piston-wise movement of voice coil 2 causes movement of the membrane 3 in the direction of the Z-axis. The upper sectional drawing shows the asymmetry of the real mechanical system of micro speaker 1, which results in asymmetrical movements, or tumbling, of membrane 3. Tumbling of the membrane 3 occurs both along the X-axis and the Y-axis. For purposes of this disclosure, the axes X, Y and Z are defined as intersecting in the middle of the width and length dimension of membrane 3. This definition also works for annular as well as rectangular transducer designs.

Tumble Detection

Although the resulting force in a dynamic speaker produces movements of membrane 3 perpendicular to the surface of membrane 3 along axis Z, small force components along axes X and Y are unavoidable. These components result in tumbling of membrane 3, where membrane 3 moves in a rotational manner, which produces no acoustic flow. The detection of membrane tumbling can be split into two components—detection along both axes X and Y. For a rectangular transducer, the two components of membrane tumbling can be called the length and width tumbling modes.

Optimization of the performance for a micro speaker 1 typically involves maximizing the magnetic force by minimizing the air gap 8 between magnet 5 and pot 7. The tumbling movement of the voice coil 2 causes periodic touching of voice coil 2 against the magnet 5 or the pot 7, leading to a buzz or rubbing, which may lead to damage of any of the components.

Figure 3:
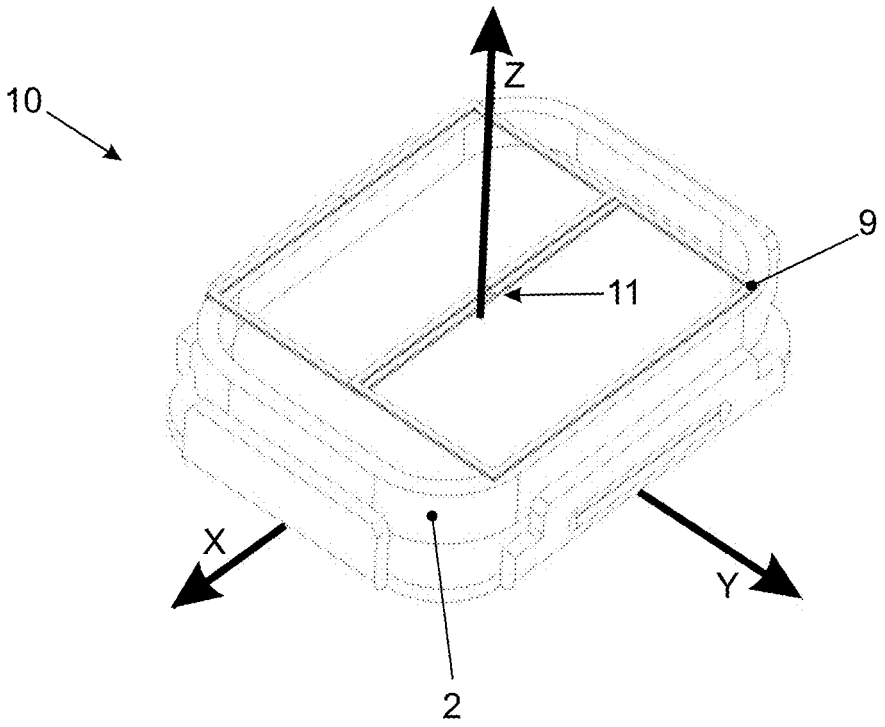
FIG. 3 shows a perspective view of some of the relevant parts of a rectangular micro speaker according to an aspect of the invention, having a figure-8 shaped detector coil.
Figure 4:
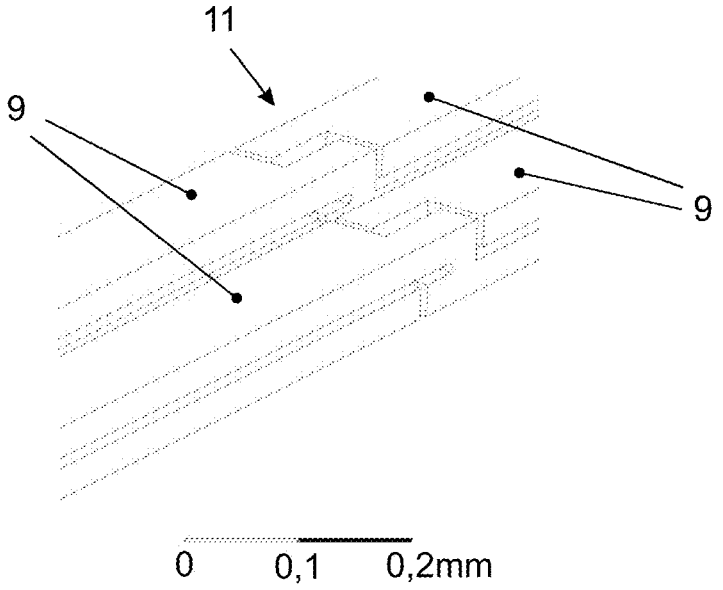
FIG. 4 shows a close-up view of a portion of the detector coil of the micro speaker of FIG. 3.

It is therefore necessary to find a way to detect tumbling electrically with a detector coil 9 of speaker 10 according to a first embodiment of the invention shown in FIG. 3. For a speaker with a single voice coil, like the prior art speaker 1, the rotational center is found within the center of gravity of the voice coil, and induced voltage due to the tumbling movement is cancelled out. No electrical footprint of the tumbling mode can be found in the impedance curve of a single coil system. Detector coil 9 therefore is formed in a figure-8 shape with a turning point 11 as shown in FIGS. 3 and 4.

Figure 8:
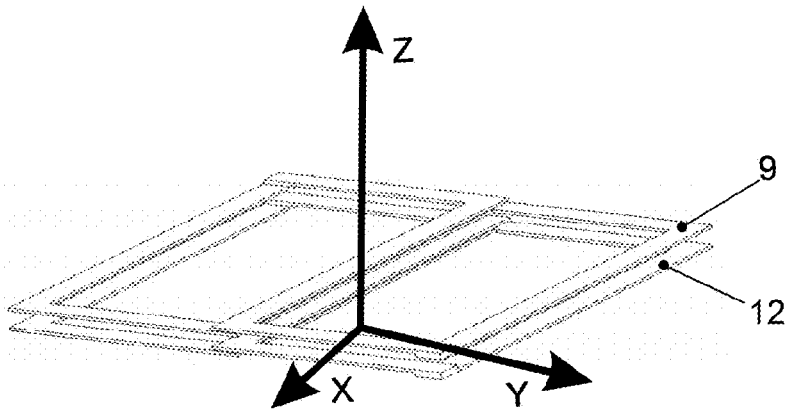
FIG. 8 shows a perspective view two figure-8 shaped coils for a rectangular micro speaker according to an aspect of the invention.

Any rotational movement around the axis X induces voltage in the figure-8 shaped detector coil 9, but voltage induced from piston wise movement along axis Z is cancelled out. Since tumbling comprises two tumbling modes along axes X and Y, two detector coils 9A and 9B are needed to detect tumbling along axis X and to detect the tumbling along axis Y as can be seen from FIG. 5

Passive Tumble Damping

The voltage induced in voice coil 2 reduces the voltage actually found on the terminals of voice coil 2, measurable as the typical transducer impedance peak around resonance. This principle can be applied to damp the tumble modes as well. Unfortunately it is not possible to form voice coil 2 in a way to work as a voice coil and additionally as a figure-8 shaped coil at the same time. Therefore separate figure-8 shaped coils 9A and 9B are needed to passively damp these rocking modes. For passive tumble damping, figure-8 shaped detector coils 9A and 9B function as damping coils as well. In order to achieve a proper rocking mode damping a trade-off between additional mass and achieved damping has to be found.

Estimation of Damping

Figure 5:
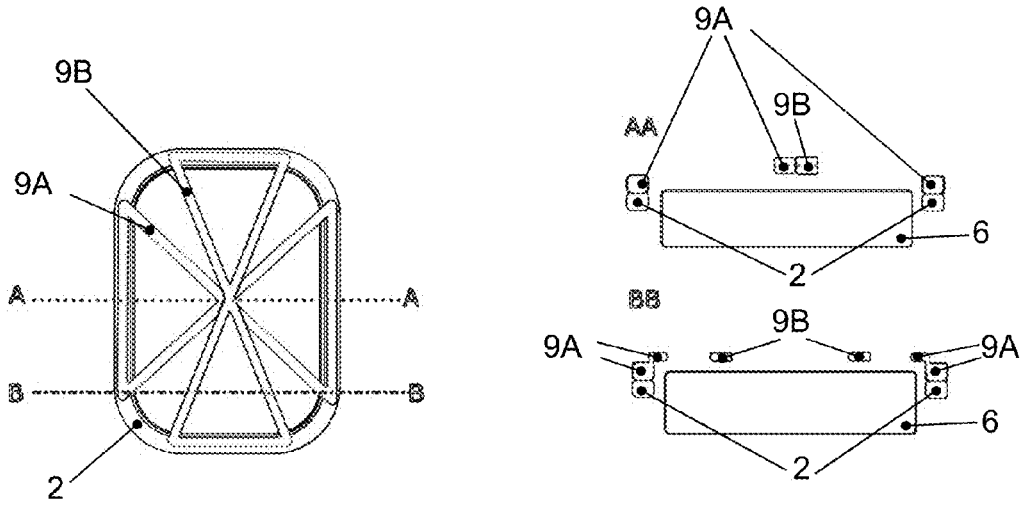
FIG. 5 shows a top view and two sectional views of some relevant parts of a rectangular micro speaker according to an aspect of the invention with two figure-8 shaped detector coils.
Figure 6:
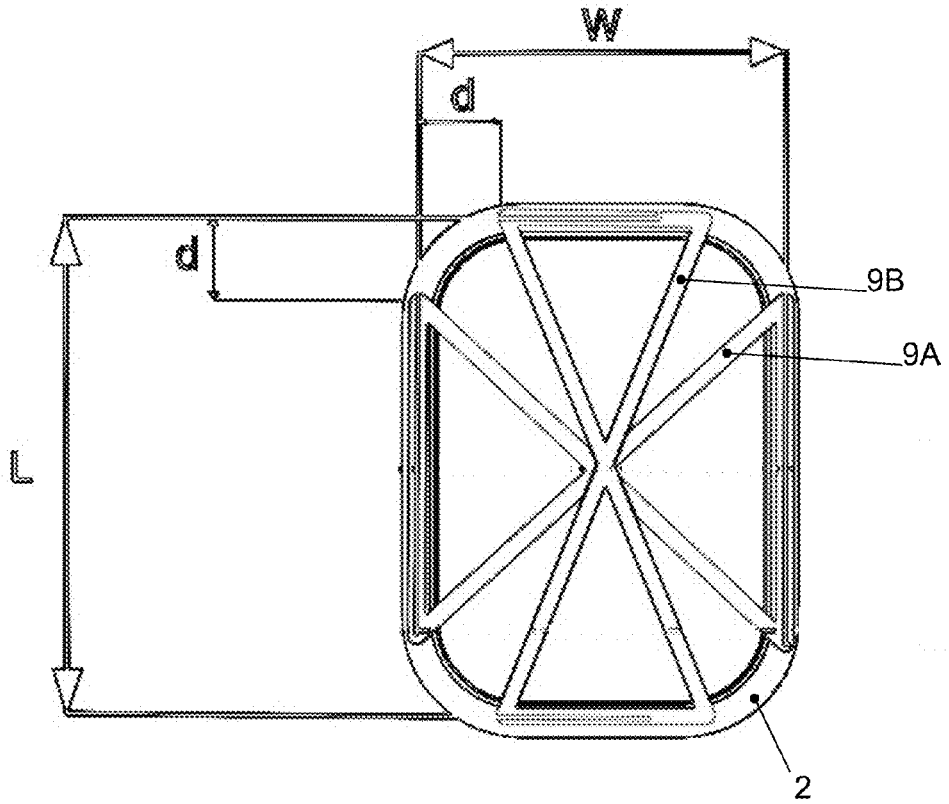
FIG. 6 shows a top view of the micro speaker of FIG. 5 with geometrical dimensions labeled.

FIG. 6 shows a top view of the figure-8 shaped damping coils 9A and 9B of FIG. 5 with geometrical dimensions labeled to calculate the voltage induced into the figure-8 shaped coils 9A and 9B. The voltage induced in coil 9A can be expressed as:

$$U=vB2(L-2d)N \tag{1}$$

With:

U induced voltage v velocity found within the magnetic flux density field B

L−2d active length in B field per side

N number of windings

The length of one winding can be expressed as $$L_R=2[(L-2d)+\sqrt{L-2d)^2+W^2}] \tag{2}$$

The electrical resistance of figure-8 shaped coil 9A can be expressed as $$R = \frac{\rho_e 2\left[(L-2d)+\sqrt{(L-2d)^2+W^2}\right]N}{A/N} = \frac{\rho_e L_R N^2}{A} \quad (3)$$

With:

$\rho_e$ specific electric resistance (Ωm)

N number of windings

A sum of all wires' cross-section

The mass of the figure-8 shaped detector coil 9A can be expressed as $$m=\rho A L_R + N \cdot G \quad (4)$$

With:

ρ volumetric mass density

G mass of isolation varnish and bonding glue per winding

It is advantageous to optimize the force that can damp the tumbling in the figure-8 shaped detector coil 9A while adding as little mass as possible to the moving parts of the speaker. A good measure therefore is to calculate the ratio of force to mass:

$$\frac{F}{m} = \frac{B2(L-2d)IN}{m} = \frac{v(2(L-2d))^2 B^2 N^2}{\frac{\rho_e L_R N^2}{A}\cdot(\rho A L_R + NG)} \quad (5)$$

With:

I current within the coil

Note that in equation (5), "I" was substituted by the induced voltage divided by the resistance.

The calculation can be simplified further as:

$$\frac{F}{m} = \frac{v(2(L-2d))^2 B^2}{\rho_e L_R\left(\rho L_R + \frac{NG}{A}\right)} \quad (6)$$

The equations above all apply to the figure-8 shaped coil 9A, but can also be used for figure-8 shaped coil 9B by swapping the dimensions L and W in each of the equations.

Figure 7A:
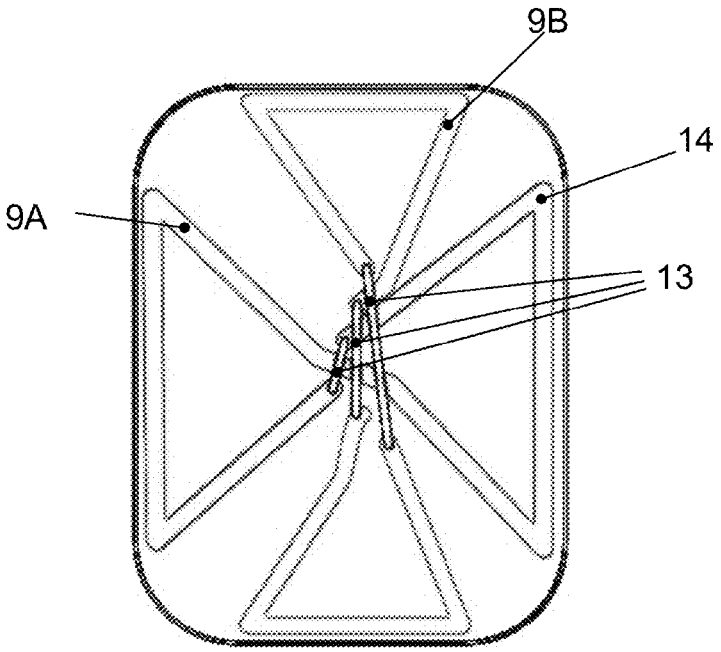
FIG. 7*a* shows a rectangular micro speaker according to an aspect of the invention having two figure-8 shaped detector coils formed as a two layer flexible circuitry.

The maximum force per mass is achieved for N=1, with all other parameters more or less restricted to design specific boundaries. This results in a single coil setup where the lower the resistivity (and hence mass) the higher the electrical damping force. One example can be seen in FIG. 7*a*, which is a two layer flexible circuit with a conductive area found within layer 13 and a conductive area found within layer 14 to form figure-8 shaped coils 9A and 9B.

Figure 7B:
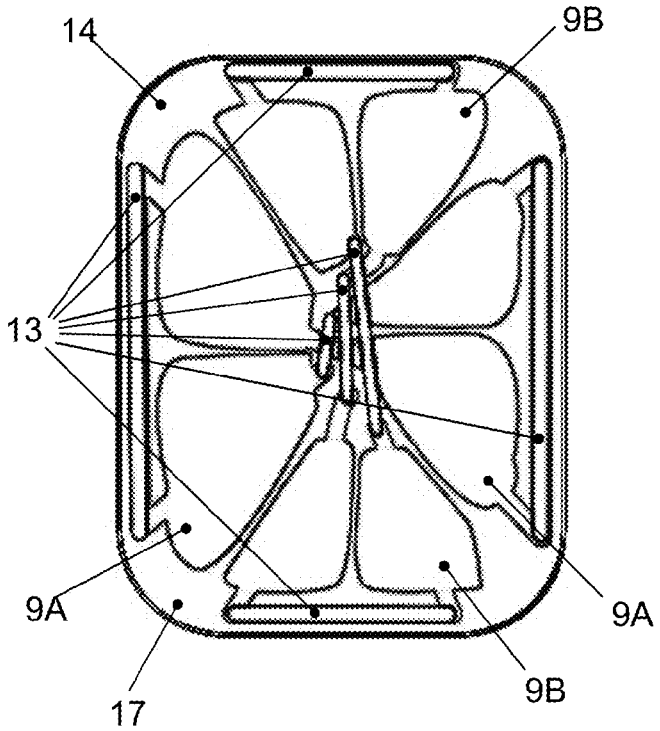
FIG. 7*b* shows a figure-8 shaped detection coil on a rectangular micro speaker according to an aspect of the invention, optimized with maximized cross-sectional areas.

FIG. 7*b* shows an optimized version of the passive figure-8 shaped coils 9A and 9B having maximum cross-sectional areas to contribute to the mechanical stiffness of membrane plate 17 formed as flexible circuit.

Active Tumble Damping

In certain situations, the passive solution above is not strong enough to damp tumbling of membrane 3. In particular, this situation occurs if:

- The B stray field is not strong enough, because the position of detector coil 9 (see equation 6, quadratic dependency) is not inside air gap 8; or
- The acoustic system does not allow for extra mass (the performance is also in a quadratic manner dependent on the cross section of detector coil 9, see equation 6).

FIG. 8 shows two figure-8 shaped coils 9 and 12 formed from flexible circuits. Two identical coils on top of each other are needed, with coil 12 acting as a damping coil and fed an amplified signal from the figure-8 shaped detection coil 9.

In this case voltage induced in detector coil 9 needs to be amplified by a simple amplifier. The difference to the passive setup explained above is found in the electric coupling between the detector coil 9 and the damping coil 12. Any feedback from the damping coil 12 into the detector coil 9 will result in instability.

The coupling factor has been simulated for such a setup and results in:

| coupling factor | Voice coil 2 | Detector coil 9 | Damping coil 12 |
|---|---|---|---|
| Voice coil 2 | 1 | 0.02 | 0.0057 |
| Detector coil 9 | 0.02 | 1 | 0.78 |
| Damping coil 12 | 0.0057 | 0.78 | 1 |

Based on this result it becomes clear that detector coil 9 and damping coil 12 are coupled very strongly and a connection to an amplifier will result in instability. Therefore a detector coil 9 design is needed that fulfils the figure-8 shaped characteristics inside the B field and is electrically decoupled as much as possible from the damping coil 12.

The mechanism of coupling between the coils can be seen from a simple conductor setup, where the H-field of a conductor is given by:

$$H = \frac{I}{2\pi r} \quad (7)$$

With:

H magnetic field strength

I current r distance to conductor

The factor 1/r is responsible for a strong coupling in the vicinity of the conductor and the figure-8 shaped coil does not compensate for this 1/r dependency.

Figure 9:
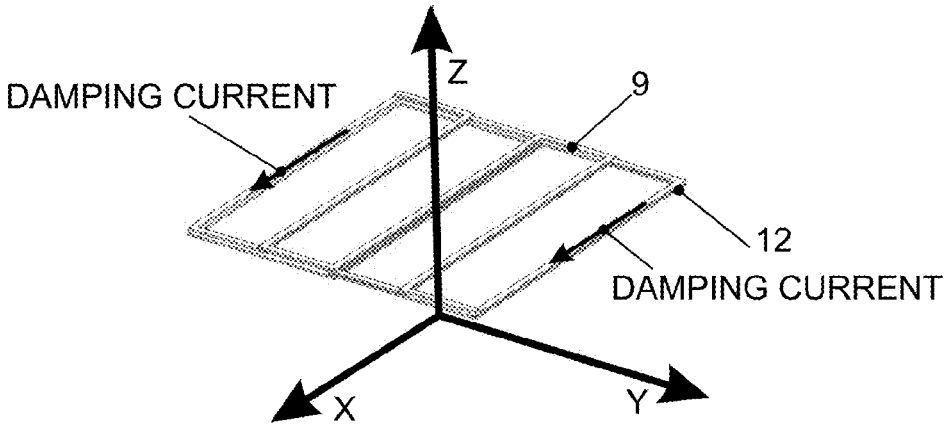
FIG. 9 shows a perspective view of a detection coil and a damping coil for a rectangular micro speaker according to an aspect of the invention.

Flipping the orientation of detection coil 9 several times ensures a better decoupling, as two coil areas with opposite orientation in the vicinity of the conductor are achieved as can be seen from FIG. 9. Note that the damping current is found in the figure-8 shaped coil 12 located under the detection coil 9. The damping coil 12 must not be flipped several times as the detection coil 9.

Figure 10A:
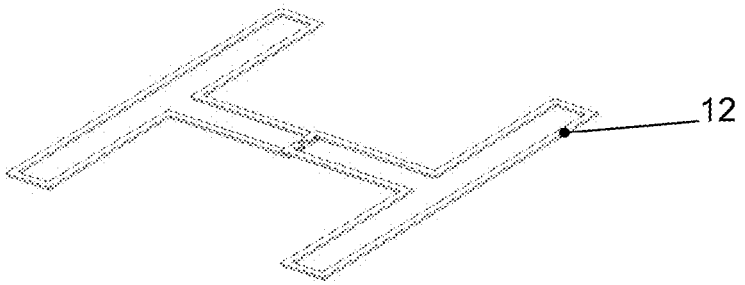
FIG. 10*a* shows a damping coil for a rectangular micro speaker according to an aspect of the invention only.
Figure 10B:
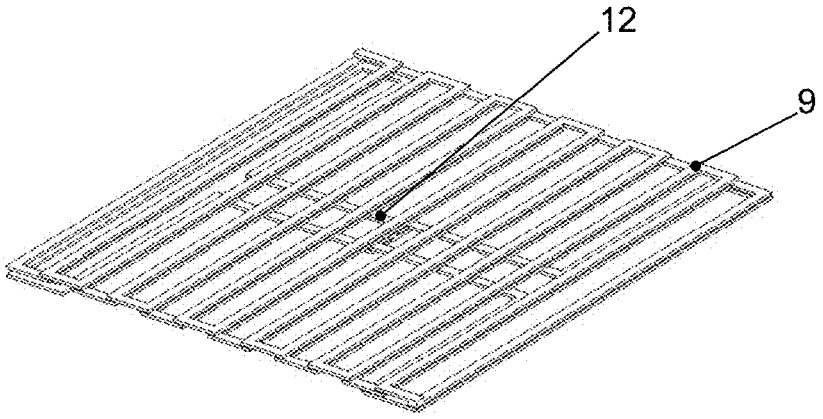
FIG. 10*b* shows a detection coil and a damping coil for a rectangular micro speaker according to an aspect of the invention.

FIG. 10*a* shows the damping coil 12 only, where the coupling effects are minimized further by a different coil shape. FIG. 10*b* shows the detection coil 9 divided into 12 subareas on top of the damping coil 12.

Figure 11:
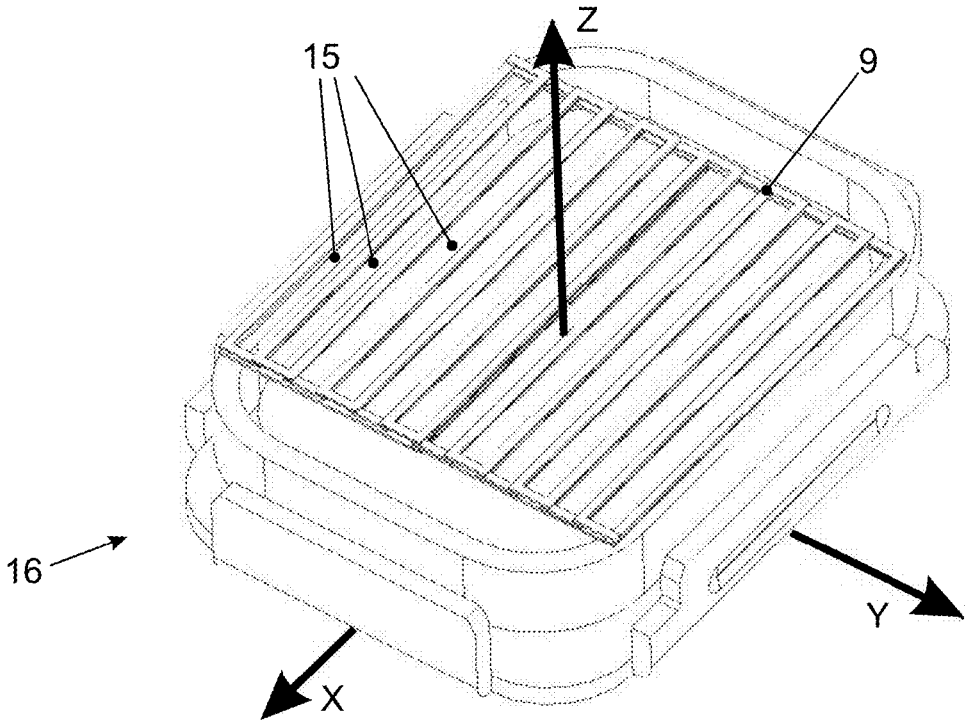
FIG. 11 shows a perspective view of some of the relevant parts of a rectangular micro speaker according to an aspect of the invention with the detection coil and damping coil of FIG. 10*b*.

A setup with 12 subareas 15 of detection coil 9 together with a simple figure-8 shaped damping coil 12 of speaker 16 as shown in FIGS. 10*a*, 10*b* and 11 yields following coupling factors:

| coupling factor | Voice coil 2 | Detector coil 9 | Damping coil 12 |
|---|---|---|---|
| Voice coil 2 | 1 | 0.00059342 | 0.0063617 |
| Detector coil 9 | 0.00059342 | 1 | 0.021203 |
| Damping coil 12 | 0.0063617 | 0.021203 | 1 |

Further improvement can be achieved by 24 subareas in detection coil 9, which yields the following coupling factors:

| coupling factor | Voice coil 2 | Detector coil 9 | Damping coil 12 |
|---|---|---|---|
| Voice coil 2 | 1 | 0.0003153 | 0.0063209 |
| Detector coil 9 | 0.0003153 | 1 | 0.0039647 |
| Damping coil 12 | 0.0063209 | 0.0039647 | 1 |

As can be seen from the coupling factors, voice coil 2 or the damping coil 12 are hardly coupled to the detector coil 9, this means that an amplification of 40 dB (factor 100) still leaves 10 dB safety margin with respect to instability.

Requirements for the Amplifier

The above calculations show that the signal from the detector coil 9 needs to be amplified in order to drive the figure-8 shaped damping coil 12. A state of the art amplifier solution is an operational amplifier with external supply. Although such an operational amplifier can be placed on the flexible circuitry, a separate supply for the amplifier requires additional wires. This solution using an amplifier may increase the costs of the speaker, but may not be necessary depending on the field of use of the speaker. It is essential to damp inaudible movements of the membrane system, so the quality of the amplified signal is only rated by the damping achieved. Even if there is hardly a correlation between the driving signal for the voice coil 2 and the expected tumbling, tumbling leads to significant problems when the excursion is high.

Figure 12:
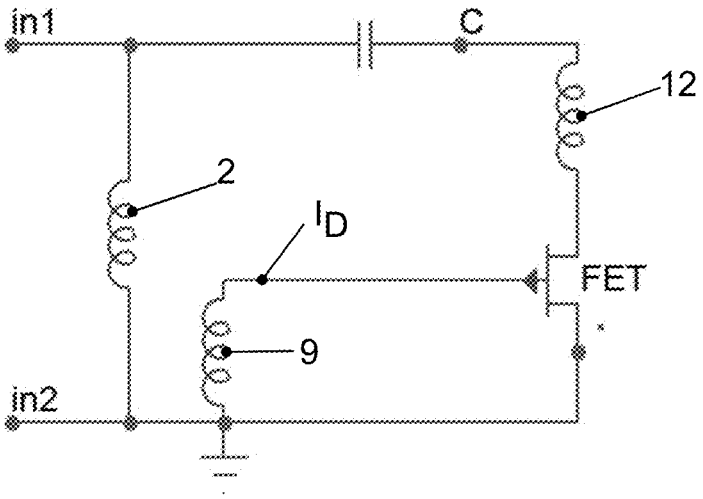
FIG. 12 shows a circuitry including a field-effect transistor to amplify the detection signal in a detection coil for a rectangular micro speaker according to an aspect of the invention.

If boundary conditions of low quality amplification and correlation of damping are combined with the signal itself, a simple field-effect transistor (FET) solution could act as an amplifier as shown in FIG. 12. Simulation of current in damping coil 12 for a 600 Hz input signal and a tumbling frequency of 1780 Hz show that a FET will work properly at high driving levels (above 1V), but prototypes with supply voltages as low as 0.3V are being developed already.

Figure 13:
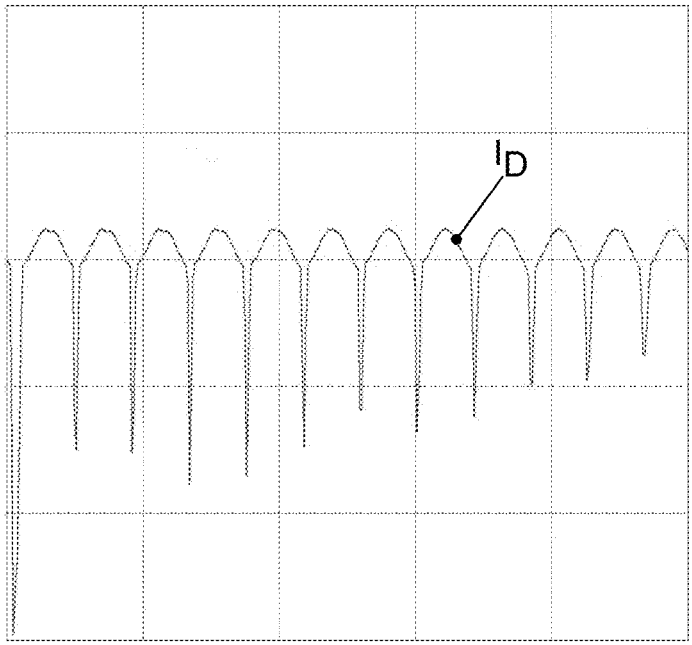
FIG. 13 is a simulated graph of the resulting current in damping coil of a rectangular micro speaker according to an aspect of the invention.

FIG. 13 shows in principle the resulting current $I_D$ of the damping signal in the damping coil 12. As can be seen during the negative period of the speaker signal in voice coil 2, detection coil 9 modulates the current $I_D$ the damping coil 12 in order to damp the tumbling movement of membrane 3.

Placement of Detection Coils

A state of the art transducer membrane can be characterized by a soft torus surrounding a stiff membrane plate. The state of the art membrane plate is a sandwich structure of a matrix stacked between two thin plates (preferably light weighted stiff materials like aluminum).

Detection coils 9 can be mounted by a structure like a print or a flexible circuit or other similar technologies and can act as the outer plate of the sandwich structure minimizing the added mass.

Advantage of the Proposed Solution

The passive tumble damping of a membrane as described above achieves an electric damping of tumbling regardless of frequency, temperature, humidity and aging. The cross-sectional area of the figure-8 shaped coils 9 and 12 is directly related to the achievable damping force and can therefore be optimized to influence the acoustical performance (resonance, sensitivity) as little as possible. The setup of damping coil 12 can be included in a state of the art spider realized as flexible circuitry to contact the voice coil 2, which acts as an additional suspension and wire loop as well.

The active tumble damping system can achieve the same features with the difference of using a supply voltage for the amplifier instead of adding mass. The amplifier can be placed on the flexible circuitry used as spider, wire loop connection and tumble damping system.

Current ultra-low supply voltage component development will allow more and more the use of the voice coil signal itself to supply the damping circuitry with energy.

The invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. An electroacoustic transducer comprising:
- a pot;
- a permanent magnet disposed within the pot;
- a top plate fixed on the magnet;
- a voice coil disposed around the permanent magnet and configured to move in a space between the pot and the permanent magnet;
- a membrane affixed to the voice coil and configured to move with movement of the voice coil; and
- a tumbling detector coil mechanically connected to the voice coil and configured to move with the voice coil;
- wherein the tumbling detector coil is configured such that any rotational movement of the voice coil about a first axis transverse to the direction of movement of the membrane induces a voltage in the tumbling detector coil.

2. The electroacoustic transducer of claim 1, wherein the voice coil has a substantially rectangular shape having a length and a width, the length being greater than the width, and wherein the first axis is parallel to the length of the voice coil.

3. The electroacoustic transducer of claim 2, wherein the tumbling detector coil spans the width of the voice coil and is formed in a figure eight shape, forming two substantially equal subareas, each subarea spanning approximately half the width of the voice coil.

4. The electroacoustic transducer of claim 2, wherein the tumbling detector coil is a first tumbling detector coil, the electroacoustic transducer further comprising a second tumbling detector coil, wherein the second tumbling detection coil is configured such that any rotational movement of the voice coil about a second axis perpendicular to the first axis and parallel to the width of the voice coil, induces a voltage in the second tumbling detector coil.

5. The electroacoustic transducer of claim 4, wherein the first tumbling detector coil spans the width of the voice coil and is formed in a figure eight shape, and the second tumbling detector coil spans the length of the voice coil and is also formed in a FIG. 8 shape.

6. The electroacoustic transducer of claim 5, wherein the first and second tumbling detector coils are formed from conductive paths on a single flexible circuit.

7. The electroacoustic transducer of claim 2, wherein the tumbling detection coil spans the width of the voice coil and is configured such that the orientation of the tumbling detection coil is reversed at least once across the width of the voice coil.

8. The electroacoustic transducer of claim 7, wherein the orientation of the tumbling detection coil is reversed three times across the width of the voice coil at substantially uniform intervals creating four substantially equal subareas within the tumbling detection coil.

9. The electroacoustic transducer of claim 7, wherein the orientation of the tumbling detection coil is reversed at least two times across the width of the voice coil at substantially uniform intervals, creating a number of uniform subareas that is one more than the number of times the orientation of the tumbling detection coil is reversed.

10. The electroacoustic transducer of claim 1, further comprising a damping coil, the damping coil having a substantially identical outer shape as the tumbling detector coil, the damping coil and tumbling detector coil arranged in a stacked configuration relative to the voice coil.

11. The electroacoustic transducer of claim 10, further comprising an amplifier configured to receive a signal representing the induced voltage in the tumbling detector coil, amplify the received signal and deliver the amplified signal to the damping coil.

12. The electroacoustic transducer of claim 10, wherein the damping coil is formed in the shape of a letter I.

* * * * *